United States Patent [19]

Burns

[11] 4,439,335

[45] Mar. 27, 1984

[54] CONCENTRATED FABRIC SOFTENING COMPOSITIONS

[75] Inventor: Michael E. Burns, West Chester, Ohio

[73] Assignee: The Procter & Gamble Company, Cincinnati, Ohio

[21] Appl. No.: 322,315

[22] Filed: Nov. 17, 1981

[51] Int. Cl.[3] ..... D06M 13/46

[52] U.S. Cl. ..... 252/8.75; 252/8.8

[58] Field of Search ..... 252/8.75, 8.8

[56] References Cited

U.S. PATENT DOCUMENTS

| | | | |
|---|---|---|---|
| 110,144 | 12/1870 | Verbuggen | 112/225 |
| 3,492,324 | 1/1970 | Blackman | 260/404.5 |
| 3,509,049 | 4/1970 | Zweidler | 252/8.75 |
| 3,658,718 | 4/1972 | Clumpner | 252/357 |
| 3,681,241 | 8/1972 | Rudy | 252/8.75 |
| 3,703,480 | 11/1972 | Grand | 252/524 |
| 3,850,818 | 11/1974 | Kalsumi et al. | 252/8.8 |
| 3,954,634 | 5/1976 | Monson et al. | 252/8.8 |
| 3,958,059 | 5/1976 | Diehl | 428/260 |
| 4,038,196 | 7/1977 | Minegishi et al. | 252/8.8 |
| 4,102,795 | 7/1978 | Minegishi | 252/8.9 |
| 4,119,545 | 10/1978 | Chazard et al. | 252/8.8 |
| 4,134,840 | 1/1979 | Minegishi | 252/8.9 |
| 4,149,978 | 4/1979 | Goffinet | 252/8.8 |
| 4,155,855 | 5/1979 | Goffinet et al. | 252/8.8 |
| 4,157,307 | 6/1979 | Jaeger et al. | 252/8.75 |
| 4,360,437 | 11/1982 | Wolfes | 252/8.8 |

FOREIGN PATENT DOCUMENTS

| | | |
|---|---|---|
| 18039 | 10/1980 | European Pat. Off. . |
| 2848892 | 5/1979 | Fed. Rep. of Germany . |
| 2905881 | 8/1980 | Fed. Rep. of Germany . |
| 55-62268 | 5/1980 | Japan . |
| 1538094 | 1/1979 | United Kingdom . |
| 1538866 | 1/1979 | United Kingdom . |
| 2007734 | 5/1979 | United Kingdom . |

*Primary Examiner*—P. E. Willis, Jr.

*Attorney, Agent, or Firm*—Richard C. Witte; Ronald L. Hemingway

[57] ABSTRACT

An aqueous concentrated cationic fabric softening composition wherein the cationic softener system comprises a binary mixture of a mono nitrogen quaternary ammonium cationic softener salt and a second cationic softener salt selected from certain di(2-amidoethyl)methyl quaternary ammonium salts and imidazolinium salts.

14 Claims, No Drawings

CONCENTRATED FABRIC SOFTENING COMPOSITIONS

FIELD OF THE INVENTION

This invention relates to fabric softening compositions and, in particular, to compositions in aqueous medium which contain a relatively high proportion of cationic fabric softening ingredients.

BACKGROUND OF THE INVENTION

Conventional rinse-added fabric softening compositions contain fabric softening agents which are substantially water-insoluble cationic materials usually having two long alkyl chains. Typical of such materials are distearyl dimethyl ammonium chloride and imidazolinium compounds substituted with two stearyl groups. These materials are normally prepared in the form of an aqueous dispersion or emulsion, and it is generally not possible to prepare such aqueous dispersions with more than about 6% of cationic material without taking special precautions to ensure acceptable viscosity and stability characteristics. Indeed, with cationic levels in excess of about 8% the problems of physical instability and high viscosity become, in the case of conventional fabric softening products, almost intractable. The formulation of fabric softener compositions with low levels of the active softener ingredients adds substantially to distribution and packaging costs.

In addition to shipping and packaging economy, another advantage of a more concentrated fabric softening composition is that it permits the consumer to exercise choice in the type of performance desired, in that the concentrated product can either be used as such or can be diluted to a conventional concentration before use. This opens up the possibility of supplying the concentrated fabric softening composition in a more economically packaged form intended for making up by the consumer into a conventional bottle.

The problem of preparing fabric softening compositions in concentrated form suitable for consumer use has already been addressed in the art, but the various solutions proposed have not been entirely satisfactory. U.S. Pat. No. 3,681,241, Rudy, issued Aug. 1, 1972, utilizes a combination of quaternary ammonium softener, saturated imidazolinium softener, unsaturated imidazolinium softener and ionizable salts to formulate concentrated softeners, but the maximum concentration achieved in that patent is only 13%. The use of certain special processing techniques for reducing viscosity has also been suggested (for example, in U.S. Pat. No. 3,954,634, Monson, issued May 4, 1976) but again this does not provide a complete and satisfactory solution, and it is not an easy matter to adopt this type of process on a commercial scale.

In U.S. Pat. No. 4,155,855, Goffinet et al., issued May 22, 1979, concentrated fabric softeners are disclosed which comprise three active softening ingredients, one of which is a highly soluble cationic fabric substantive agent. While such compositions do allow a high concentration of active ingredient, their overall softening performance is less cost effective than is the case with compositions containing predominantly a water-insoluble cationic softener. In U.S. Pat. No. 4,149,978, Goffinet, issued Apr. 17, 1979, mixtures of cationic softener and paraffinic materials are proposed in a certain ratio which can allow the preparation of concentrated softening compositions when relatively high proportions of paraffinic materials are employed. Paraffins are not essential components of the compositions of the present invention and are preferably absent therefrom. Dutch Patent Application No. 6706178 relates to viscosity control in fabric softening compositions with up to 12% of cationic softener, and suggests the use of low molecular weight hydrocarbons for this purpose. British Pat. No. 1,538,094, Hoechst, published Jan. 17, 1979, discloses a complex softener/disinfectant composition in which a long-chain fatty alcohol used at a relatively low ratio of cationic softener to alcohol is suggested as a solubilization aid. European Patent Application No. 0013780, published Aug. 6, 1980, discloses concentrated aqueous fabric softener compositions comprising a cationic softener and a viscosity control agent selected from the group consisting of hydrocarbons, fatty acids, fatty acid esters and fatty alcohols. European Patent Application No. 0018039, published Oct. 29, 1980, discloses concentrated aqueous fabric softening compositions comprising an insoluble cationic softener, a water-soluble nonionic or cationic surfactant and a hydrophobic adjunct selected from $C_{12}$ to $C_{20}$ paraffins and esters of $C_{12}$ to $C_{24}$ fatty acids and $C_1$ to $C_8$ fatty alcohols. Water-insoluble fatty nonionic materials are not essential to the compositions herein and are preferably absent therefrom.

The object of the present invention is to provide highly concentrated aqueous fabric softening compositions, based on cationic softener systems, which do not require substantial quantities of materials other than the cationic softeners to ensure physical stability and acceptable viscosity.

SUMMARY OF THE INVENTION

The invention relates to highly concentrated aqueous liquid fabric softener compositions which comprise a mixture of specific types of cationic softeners and an ionizable salt, wherein the mixture of cationic softeners has an Iodine Value of at least about 5.7.

DESCRIPTION OF THE PREFERRED EMBODIMENTS

In accordance with the present invention it has been found that when certain cationic softeners are formulated within certain proportions, highly concentrated aqueous fabric softening compositions can be prepared which contain in the order of 15% to 23% cationic softener ingredients. Specifically, the present invention is directed to concentrated aqueous fabric softener compositions which are pourable at 40° F., the said compositions comprising:

A. from about 2% to about 12.5% of a mono nitrogen quaternary ammonium cationic softener salt having the formula

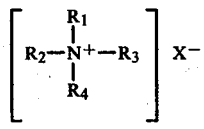

wherein $R_1$ and $R_2$ can be the same or different from each other and are selected from the group consisting of $C_{14}$ to $C_{20}$ alkyl and alkenyl groups, $R_3$ and $R_4$ can be the same or different and are selected from the group consisting of $C_1$ to $C_3$ alkyl or $-(C_nH_{2n}O)_xH$ groups wherein n is 2 or 3, x is from 1 to about 3, and wherein $X^-$ is an anion selected from halide, methylsulfate or ethylsulfate;

B. from about 5% to about 18% of a second cationic softener salt selected from the group consisting of

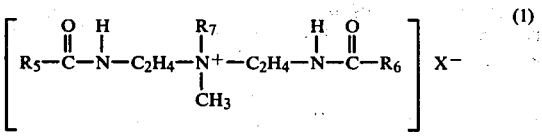

(1)

wherein $R_5$ and $R_6$ are the same or different from each other and are selected from the group consisting of $C_{14}$ to $C_{20}$ alkyl and alkenyl groups, wherein $R_7$ is selected from the group consisting of H, methyl, ethyl and $(C_nH_{2n}O)_xH$ wherein n is 2 or 3 and x is from 1 to about 5 and wherein $X^-$ is selected from halide, ethylsulfate or methylsulfate;

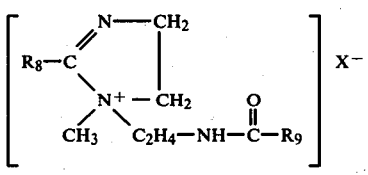

(2)

wherein $R_8$ and $R_9$ are the same or different from each other and are selected from the group consisting of $C_{14}$ to $C_{20}$ alkyl and alkenyl groups, wherein $X^-$ is halide, ethylsulfate or methylsulfate;

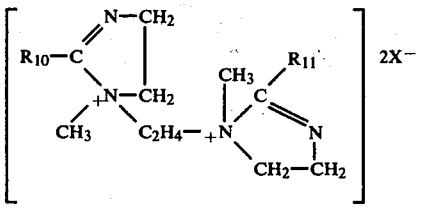

(3)

wherein $R_{10}$ and $R_{11}$ can be the same or different from each other and are selected from the group consisting of $C_{14}$ to $C_{20}$ alkyl and alkenyl and $X^-$ is halide, methylsulfate or ethylsulfate;

C. from about 0.05% to 0.6% of an inorganic water-soluble ionizable salt; and

D. water;

wherein the total amount of Components A+B is from about 15% to about 23% (preferably about 18% to about 21%), wherein there is unsaturation present on at least one of Components A or B such that the cationic active system has an Iodine Value of at least about 5.7, preferably at least about 7.7, and most preferably from about 10.5 to about 34.

The compositions of the invention are stable and pourable at normally encountered temperatures (40°-100° F.) and are easily dispersible in water. In the context of the present invention, "pourable" means having a viscosity below about 5000 cP as measured by a Brookfield Synchro-lectric Viscometer with Spindle #4 at 60 rpm. The compositions provide excellent fabric softening and antistatic performance in laundry rinse solutions containing from about 25 ppm to about 90 ppm of the combination of Components A and B.

The mono nitrogen quaternary ammonium cationic salt softener of the compositions herein has the structure:

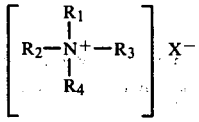

wherein $R_1$ and $R_2$ can be the same or different from each other and are selected from the group consisting of $C_{14}$ to $C_{20}$ alkyl and alkenyl groups and $R_3$ and $R_4$ are the same or different from each other and are selected from the group consisting of $C_1$ to $C_3$ alkyls, or $-(C_nH_{2n}O)_xH$ wherein n is 2 or 3, x is from 1 to about 3, and wherein $X^-$ is halide, methylsulfate or ethylsulfate. It is preferred that $X^-$ be halide, and the preferred halides are chloride and bromide. It is preferred that $R_1$ and $R_2$ be alkyl, i.e., it is preferred that the unsaturation in the cationic active system come from Component B. Exemplary Component A compounds are dimyristyldimethyl ammonium chloride, dipalmityldiethyl ammonium bromide, distearyldimethyl ammonium chloride, distearyldimethyl ammonium bromide, distearyldiisopropyl ammonium bromide, diarachidyldimethyl ammonium chloride, distearyl-2-hydroxypropylmethyl ammonium chloride, oleylstearyldimethyl ammonium ethylsulfate and distearyl-2-hydroxyethylmethyl ammonium methylsulfate. Preferably the $R_1$ and $R_2$ groups are derived from tallow and the $R_3$ and $R_4$ groups are methyl. The tallow can be hydrogenated or unhydrogenated. Hydrogenated (i.e., saturated) tallow is preferred, and halides are the preferred anions. Accordingly, preferred mono nitrogen quaternary ammonium salt softener compounds herein are dihydrogenatedtallowdimethyl ammonium chloride and dihydrogenatedtallowdimethyl ammonium bromide. Hydrogenated tallow often has some residual degree of unsaturation such that the Iodine Value of hydrogenated ditallowdimethyl ammonium salts can be up to about 5.

Exemplary commercial quaternary ammonium salts which are suitable for use as Component A in the compositions herein are dihydrogenatedtallowdimethyl ammonium chloride sold under the name Adogen 442, and ditallowdimethyl ammonium chloride (I.V. about 20-30) sold under the name Adogen 470, both from Sherex Chemical Company.

The Component A quaternary ammonium salts are used in the compositions herein at levels of from about 2% to about 12.5%, preferably from about 5% to about 10%. (All percentages and proportions herein are "by weight" unless specified otherwise).

Component B in the compositions herein is selected from certain di(2-amidoethyl)methyl ammonium salts and imidazolinium salts, designated respectively herein as B.(1) through B.(3).

The di(2-amidoethyl)methyl quaternary ammonium salts suitable for use as Component B.(1) in the compositions of the invention herein have the structure

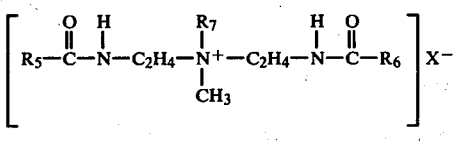

wherein $R_5$ and $R_6$ are the same or different from each other and are selected from the group consisting of $C_{14}$ to $C_{20}$ alkyl and alkenyl groups, wherein $R_7$ is selected from H, methyl, ethyl and $-(C_nH_{2n}O)_xH$ wherein n is 2 or 3 and x is from 1 to about 5 (preferably 3), and wherein $X^-$ is an anion selected from halide, ethylsulfate or methylsulfate. Preferably $R_5$ and $R_6$ are alkyl and $R_7$ is $-(C_nH_{2n}O)_xH$. This class of compounds is disclosed in U.S. Pat. No. 4,134,840, Minegishi et al., issued Jan. 16, 1979, incorporated herein by reference.

Exemplary compounds are di(2-hydrogenatedtallowamidoethyl) ethoxylated (2 ethoxy groups) methyl ammonium methylsulfate, di(2-hydrogenatedtallowamidoethyl) dimethyl ammonium ethylsulfate, di(2-palmitylamidoethyl) hydromethyl ammonium chloride, di(2-oleylamidoethyl) propoxylated (3 propoxy groups) methyl ammonium bromide, di(2-palmitoleylamidoethyl) dimethyl ammonium ethylsulfate and di(2-stearylamidoethyl) propoxylated (2 propoxy groups) methyl ammonium methylsulfate.

Exemplary commercial materials suitable for use as Component B.(1) herein are di(2-hydrogenatedtallowamidoethyl) ethoxylated methyl ammonium methylsulfate sold under the name Varisoft 110, and di(2-tallowamidoethyl) ethoxylated methyl ammonium methylsulfate (I.V. about 31) sold under the name Varisoft 222, both from Sherex Chemical Company.

Component B.(2) has the formula:

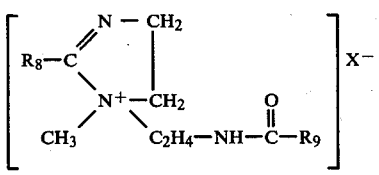

wherein $R_8$ and $R_9$ are the same or different from each other and are selected from the group consisting of $C_{14}$ to $C_{20}$ alkyl and alkenyl groups, wherein $X^-$ is halide, ethylsulfate or methylsulfate.

Exemplary compounds of this type are: 1-methyl-1-tallowamidoethyl-2-tallowimidazolinium methylsulfate, 1-methyl-1-oleylamidoethyl-2-oleylimidazolinium chloride, 1-methyl-1-palmitoleylamidoethyl-2-palmitoleylimidazolinium ethylsulfate, 1-methyl-1-soyaamidoethyl-2-soyaimidazolinium methylsulfate and 1-methyl-1-hydrogenatedtallowamidoethyl-2-hydrogenatedtallowimidazolinium methylsulfate. Exemplary commercial materials are 1-methyl-1-tallowamidoethyl-2-tallowimidazolinium methylsulfate (I.V. about 42) sold under the name Varisoft 475, and 1-methyl-1-hydrogenatedtallowamidoethyl-2-hydrogenatedtallowimidazolinium methylsulfate sold under the name Varisoft 445, both available from Sherex Chemical Company.

Component B.(3) has the formula:

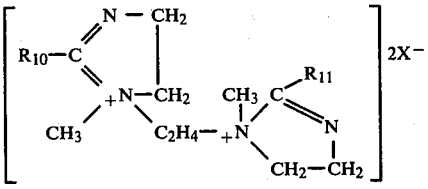

wherein $R_{10}$ and $R_{11}$ can be the same or different from each other and are selected from the group consisting of $C_{14}$ to $C_{20}$ alkyl and alkenyl and $X^-$ is halide, methylsulfate or ethylsulfate.

Exemplary compounds of this type are: 1-ethylene bis(2-stearyl, 1-methyl, imidazolinium methylsulfate), 1-ethylene bis(2-oleyl, 1-methyl, imidazolinium methylsulfate) and 1-ethylene bis(2-tallow, 1-methyl, imidazolinium methylsulfate). The tallow derivative, in hydrogenated or unhydrogenated form, is commercially available from Sherex Chemical Company under the name Varisoft 6112. The unhydrogenated material has an I.V. of about 29.

Component B in the compositions herein is used at levels of from about 5% to about 18%, preferably from about 8% to about 12%, in the compositions herein. Component B can be a single material selected from B.(1) through B.(3) or any mixture of such materials.

An essential feature of the compositions herein is that the cationic active system in the composition (i.e., Component A + Component B) has an Iodine Value (I.V.) of at least about 5.7, i.e., a substantial amount of unsaturation must be present. In accordance with the invention it has been found that high active compositions which are based on substantially waterinsoluble cationic softeners, such as those of the invention, cannot be made without having a substantial amount of unsaturation in the cationic active system. When using all-saturated active systems, the compositions will gel and become unusable at room temperature and below. Preferably the I.V. is at least about 7.7 and is most preferably from about 10.5 to about 34. The unsaturation can come from Component A or B or from a combination thereof. I.V. is a direct measure of the unsaturation and is based upon the reaction of iodine with unsaturated bonds in a molecule. The I.V. is defined as the number of decigrams of iodine which will react with one gram of the cationic active system. The standard technique for determining I.V. is well known in the art. If one knows the I.V. of the individual components which are used in the active system, then the I.V. of the system can simply be calculated by multiplying the I.V. of each component by the percentage of that component in the composition and then dividing by the total percentage of components in the composition. For example, in a composition of the invention which contains 10% Component A and 10% Component B, wherein Component A has an I.V. of 0 and Component B has an I.V. of 40, the I.V. of the cationic active system is 20 (i.e., $10 \times 40 \div 20$).

It will be appreciated by those skilled in the art that not all possible combinations of Components A and B throughout the total active level range of 15% to 23% will produce 40° F.-pourable compositions throughout the range of I.V.'s specified. Generally at the higher active levels, or at the higher proportions of Component A in the system, I.V.'s higher than the minimum level set forth herein are required. Also, generally if the unsaturation comes from Component A, a higher I.V. will be required than if the same quantity of unsaturation comes from Component B. Generally higher cationic system I.V.'s in the composition give a higher degree of pourability. However, excessively high I.V.'s (i.e., above about 40) should be avoided since these can result in gelling in some instances during the making process.

Examples of various compositions of the invention wherein the cationic level and the source and amount of unsaturation are varied are illustrated in the following table.

TABLE I

| Component (%) | Formulas 1 | 2 | 3 | 4 | 5* | 6 | 7 | 8 |
|---|---|---|---|---|---|---|---|---|
| A (sat.) | 10 | 10 | 10 | 8.06 | — | 8 | 2 | 2.5 |
| A (unsat. I.V. = 33.3) | — | — | — | — | 10 | — | — | 7.5 |
| B.(1)(sat.) | — | — | 3.07 | 5 | 10 | — | — | — |
| B.(1) (unsat. I.V. = 30.9) | 10 | — | 6.93 | 6.93 | — | 12 | — | — |
| B.(2) (sat.) | — | 5 | — | — | — | — | 6 | — |
| B.(2) (unsat. I.V. = 42.7) | — | 5 | — | — | — | — | 12 | 10 |
| $CaCl_2$ - ppm | 3000 | 3250 | 4000 | 4500 | 3875 | 5000 | 1850 | 4500 |
| Alcohol | 3 | 2.9 | 2.1 | 2.2 | 2.3 | 2.0 | 2.3 | 2.3 |
| Dye solution | 0.2 | 0.5 | 0.5 | 0.5 | 0.5 | 0.5 | 0.5 | 0.5 |
| Perfume | 0.25 | 0.75 | 0.5 | 0.5 | 0.5 | 0.5 | 0.5 | 0.5 |
| Iodine Value | 15.4 | 10.7 | 10.7 | 10.7 | 16.6 | 18.5 | 25.6 | 33.8 |

Component A is ditallowdimethyl ammonium chloride
Component B.(1) is di(2-tallowamidoethyl)ethoxylated methylammonium methylsulfate
Component B.(2) is 1-methyl-1-tallowamidoethyl-2-tallow imidazolinium methylsulfate
*Component B.(1) in this formula is the nonethoxylated version (i.e., $R_7$ is H).
All compositions are adjusted to about pH 6 with NaOH or HCl, as needed.

A wide variety of ionizable salts can be used as Component C in the compositions herein. The particular salt should be sufficiently soluble in the compositions to produce a concentration in solution of from about 500 to about 6000 ppm (preferably about 500 to about 4000 ppm) and should not adversely interact with the fabric softener compounds. Examples of suitable salts are the halides of the Group 1A and 2A metals of the Periodic Table of Elements, e.g., sodium chloride, potassium bromide, lithium chloride, calcium chloride and magnesium chloride. The ionizable salts provide viscosity control, particularly during the process of mixing the ingredients to make the compositions herein.

The water used in the compositions herein is preferably distilled or deionized water and is generally present at levels of from about 76% to 84%.

In preferred compositions herein, a saturated Component A compound is used in combination with a saturated Component B.(1) compound and an unsaturated Component B.(2) compound. Such compositions are described in more detail in application U.S. Ser. No. 318,772 Burns, filed Nov. 6, 1981, a continuation-in-part of application Ser. No. 207,862, filed Nov. 18, 1980, both applications being incorporated by reference herein.

In a particularly preferred composition, a saturated Component A compound, dihydrogenatedtallowdimethyl ammonium chloride, e.g., Varisoft 442 (Sherex Chemical Co.), is used in combination with a Component B.(1) compound, di(2-hydrogenatedtallowamidoethyl) ethoxylated methyl ammonium methylsulfate, e.g., Varisoft 110 (Sherex Chemical Co.), and a Component B.(2) compound, 1-methyl-1-tallowamidoethyl-2-tallowimidazolinium methylsulfate (I.V. about 42), e.g., Varisoft 475 (Sherex Chemical Co.). Preferably they are used in a ratio of 10% Varisoft 442, 5% Varisoft 110 and 5% Varisoft 475. The I.V. of this cationic softener system is about 10.5. Calcium chloride, at a level of about 2650 ppm, is a preferred ionizable salt for said composition.

Various optional materials such as are ordinarily used in fabric softening compositions can be used in the compositions herein. These include, for example, perfumes at 0.1% to 1.0%, antimicrobials at 0.01% to 0.1% and dyes at 0.001% to 0.01%.

In general, it is conventional to include lower aliphatic alcohols such as ethanol and isopropanol in liquid fabric softener compositions; in fact, the softening ingredients are normally sold to the formulator in the form of 70% to 90% pastes in which a lower alcohol is a diluent. It has been found that the compositions herein should preferably be substantially free of lower aliphatic alcohols, and that in any event these alcohols should not be present in said compositions at levels in excess of about 3%. If the softener ingredients are purchased as dispersions in amount of alcohol which would produce alcohol levels in excess of about 3% in the finished compositions herein, some or all of the alcohol should be removed (e.g., by heat-assisted evaporation) before use in preparing the compositions herein. Lower alcohols tend to cause viscosity increase during storage (particularly at higher storage temperatures) and if the alcohol is isopropanol, the odor imparted to the finished product is undesirable.

Agents which facilitate recovery of the compositions to a stable homogeneous liquid condition after having been subjected to freezing can be included in the compositions. Preferred freeze-thaw recovery agents are the di-polyethoxy monoalkyl amines of the formula

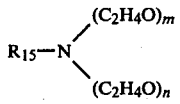

wherein $R_{15}$ is an alkyl or alkenyl group of from about 14 to 20 carbon atoms and the sum of m+n is from about 10 to about 25. A preferred material is sold under the name Varonic T220 by Sherex Chemical Company wherein $R_{15}$ is unhydrogenated tallow and the sum of m+n is about 20. Freeze-thaw agents are used in the compositions herein at levels of about 1%.

Care must be exercised in the preparation of the compositions herein. The order of addition and manner of mixing the components can have a significant effect on the physical characteristics of the composition. A particularly preferred method of preparation is as follows. Components A and B (and dyes, if used) are heated and blended together to form a melt at about 170°-185° F. This melt is then added gradually to 110° F. water with vigorous agitation. A portion of the ionizable salt is added to the water concurrently with the melted softeners at a rate necessary to keep the aqueous mix fluid and stirrable. Upon completion of the addition of the melted softeners, the remainder of the ionizable salt is added to produce the desired viscosity. Optional ingredients such as perfume, etc., are added after the viscosity of the mix has been reduced by the addition of most of the ionizable salt. After completion of the addition of ionizable salt the composition is cooled to room temperature before filling into containers.

It is desirable that the compositions herein have a pH of from about 5.5 to about 6.5. Acids such as hydrochloric, sulfuric or citric or bases such as sodium hydroxide or sodium carbonate can be added, as needed, to the compositions to achieve the desired pH. Normally, only very small amounts of such pH adjusting agents are required.

The invention will be further illustrated by the following examples.

EXAMPLE I

This example illustrates the preparation of a 200 lb. batch of a composition of the present invention.

Materials

[1]23 lbs. 87% active dihydrogenatedtallowdimethylammonium chloride (DTDMAC)
[2]22.2 lbs. 90% active di(2-tallowamidoethyl) ethoxylated methyl ammonium chloride (Varisoft 222)
0.4 lb. of 1.35% solution of Polar Brilliant Blue dye in water
1050 ml 25% w/v $CaCl_2$ in water
0.5 lb. perfume
151.9 lbs. deionized water
[1]Contains 9% ethanol
[2]Contains 9% isopropanol

Equipment 20 gallon capacity steam-jacketed pre-mix tank;
60 gallon capacity main-mix tank equipped with vertically mounted, variable speed (50–500 rpm) mixer with impeller

Procedure

The pre-mix tank was charged with the molten softener actives in the sequence DTDMAC, Varisoft 222. The resulting mixture was heated with stirring to 170° F. at which time the dye solution was added. Heating of the mixture then continued until a temperature of 175° F. was reached.

The main-mix tank was charged with 18.2 gal. (151.9 lbs.) of deionized water which was then heated to 110° F. The agitator speed was set at 150 rpm and the contents of the pre-mix tank (at 175° F.) were pumped into the main-mix tank over a period of 4 minutes. During this 4 minute period the agitator speed was gradually increased to 275–300 rpm as the main-mix thickened. Also, beginning at the point where about one-half of the premix had been added, the $CaCl_2$ solution was added in portions (see table below) at such a rate as to maintain a stirrable, flowable mixture. As the viscosity decreased the agitator speed was gradually reduced back to 150 rpm.

The perfume was added 16 minutes after the start of addition of the active premix to the main-mix tank. Addition of $CaCl_2$ solution continued until the viscosity of the warm product was 132 cP. This required a final concentration of 2890 ppm (0.29% $CaCl_2$). Upon cooling to room temperature the resulting 200 lbs. of product had a viscosity of 97 cP.

The following table records the chronology of $CaCl_2$ solution addition to the main-mix tank and corresponding viscosity readings, where taken.

| Time (Min:Sec)* | Total ml $CaCl_2$ | Viscosity (cP) |
|---|---|---|
| 2:40 | 15 | |
| 2:55 | 45 | |
| 3:15 | 80 | |
| 3:30 | 110 | |
| 3:40 | 160 | |
| 3:55 | 210 | |
| 5:00 | 300 | 500 |
| 6:25 | 345 | |
| 6:45 | 365 | 500 |
| 8:30 | 475 | |
| 8:55 | 540 | 431 |
| 10:55 | 660 | 278 |
| 12:55 | 745 | 217 |
| 15:05 | 875 | 160 |
| 16:00 | add perfume | |
| 19:00 | 875 | 180 |
| 20:10 | 1000 | 138 |

-continued

| Time (Min:Sec)* | Total ml $CaCl_2$ | Viscosity (cP) |
|---|---|---|
| 23:25 | 1050 | 132 |

The composition above had the following approximate formula:

| Component | Wt. % |
|---|---|
| Dihydrogenatedtallowdimethyl ammonium chloride | 10 |
| Di(2-tallowamidoethyl) ethoxylated methyl ammonium methylsulfate (I.V. 31) | 10 |
| Polar Brilliant Blue dye | 27 ppm |
| Calcium chloride | 0.289 |
| Perfume | 0.25 |
| Ethanol | 1.04 |
| Isopropanol | 1.00 |
| $H_2O$ | to 100 |

The I.V. of the total cationic active system is 15.5.

This composition exhibits good softening and antistatic performance and is stable and pourable between 40° F. and 100° F.

EXAMPLE II

This example illustrates a composition wherein a Component A softener is used in combination with a Component B.(1) and a Component B.(2) softener wherein all of the unsaturation is provided by the Component B.(2) softener.

Materials

[1]23 lbs. 87% active dihydrogenatedtallowdimethylammonium chloride (DTDMAC)
[2]13.3 lbs 75% active di(2-hydrogenatedtallowamidoethyl) ethoxylated methyl ammonium methylsulfate (Varisoft 110)
[3]11.1 lbs 90% active 1-methyl-1-unsaturatedtallowamidoethyl-2-unsaturatedtallowimidazolinium methylsulfate (Varisoft 475, I.V. 42)
1.2 lbs. 1.35% solution of Polar Brilliant Blue dye in water
960 ml 25% w/v $CaCl_2$ in water
1.5 lbs. perfume
147 lbs. deionized water
120 g. 20% w/v NaOH in water
[1]Contains 8% ethanol.
[2]Contains 12% isopropanol.
[3]Contains 10% isopropanol.

Equipment 20 gallon capacity steam-jacketed pre-mix tank
60 gallon capacity main-mix tank equipped with vertically mounted, variable speed (50–500 rpm) mixer with impeller

Procedure

The pre-mix tank was charged with the molten softener actives in the sequence DTDMAC, Varisoft 110, Varisoft 475. The resulting mixture was heated with stirring to 170° F., at which time the dye solution was added. Heating of the mixture then continued until a temperature of 185° F. was reached.

The main-mix tank was charged with 17.6 gal. (147 lbs.) of deionized water which was then heated to 110° F. The agitator was set at 150 rpm and the contents of the pre-mix tank (at 185° F.) were pumped into the main-mix tank over a period of 5 minutes. During this 5 minute period the agitator speed was gradually increased to 275–300 rpm as the main-mix thickened. Also, beginning at the point where about one-half of the premix had been added, the $CaCl_2$ solution was added in portions (see table below) at such a rate as to maintain a stirrable, flowable mixture. As the viscosity decreased the agitator speed was gradually reduced back to 150 rpm. The 120 g. of 20% NaOH solution was added about 7 minuts after the start of addition of the active pre-mix to the main-mix tank. (This solution of NaOH serves to adjust the final product pH to 6.0 and also reduces product viscosity).

The perfume was added 20 minutes after the start of addition of the active pre-mix to the main-mix tank. Addition of $CaCl_2$ solution continued until the viscosity of the warm product was 140 cP. This required a final concentration of 2650 ppm (0.265% $CaCl_2$). Upon cooling to room temperature the resulting 200 lbs. of product had a viscosity of 95 cP.

The followng table records the chronology of $CaCl_2$ solution addition to the main-mix tank and corresponding viscosity readings, where taken.

| Time (Min:Sec)* | Total ml $CaCl_2$ | Viscosity (cP) |
|---|---|---|
| 2:10 | 30 | |
| 2:39 | 50 | |
| 2:55 | 100 | |
| 3:25 | 115 | |
| 3:40 | 200 | |
| 4:00 | 225 | |
| 4:10 | 260 | |
| 4:45 | 300 | |
| 7:00 | (add NaOH) | |
| 8:15 | 400 | |
| 10:00 | 400 | 420 |
| 15:00 | 550 | 235 |
| 20:00 | 650 | 173 |
| 20:00 | (add perfume) | |
| 25:00 | 700 | 213 |
| 30:00 | 800 | 175 |
| 35:00 | 900 | 155 |
| 40:00 | 960 | 140 |

*Time O is the point where addition of the contents of the pre-mix tank to the main-mix tank begins.

The composition above had the following approximate formula:

| Component | Wt. % |
|---|---|
| Dihydrogenatedtallowdimethyl ammonium chloride | 10 |
| Di(2-hydrogenatedtallowamidoethyl) ethoxylated methyl ammonium methylsulfate | 5 |
| 1-methyl-1-tallowamidoethyl-2-tallowimidazolinium methylsulfate (I.V. 42) | 5 |
| Polar Brilliant Blue dye | 80 ppm |
| Calcium chloride | 0.265 |
| Perfume | 0.75 |
| Ethanol | 0.92 |
| Isopropanol | 1.36 |
| $H_2O$ | to 100 |

The Iodine Value of the total cationic active system was 10.5.

This composition exhibits excellent softening and antistatic performance and has excellent physical stability and pourability between 40° F. and 100° F. Another formula which exhibits comparable performance, physical stability and pourability is made as above except that the active system consists of 5% dihydrogenatedtallowdimethyl ammonium chloride, 10% di(2-hydrogenatedtallowamidoethyl) ethoxylated methyl ammonium methylsulfate and 5% 1-methyl-1-tallowamidoethyl-2-tallowimidazolinium methylsulfate (Varisoft 475). This formula also has an Iodine Value of 10.5 for the total cationic active system.

What is claimed is:

1. Concentrated aqueous fabric softener compositions which are pourable at 40° F., the said compositions comprising:

A. from 8% to about 12.5% of a mono nitrogen quaternary ammonium cationic softener salt having the formula

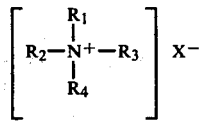

wherein $R_1$ and $R_2$ can be the same or different from each other and are selected from the group consisting of $C_{14}$ to $C_{20}$ alkyl and alkenyl groups, $R_3$ and $R_4$ can be the same or different and are selected from the group consisting of $C_1$ to $C_3$ alkyl or $-(C_nH_{2n}O)_xH$ groups wherein n is 2 or 3, x is from 1 to about 3, and wherein $X^-$ is an anion selected from halide, methylsulfate or ethylsulfate;

B. from about 5% to about 18% of a second cationic softener salt selected from the group consisting of

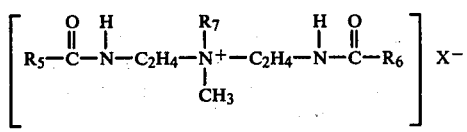

(1)

wherein $R_5$ and $R_6$ are the same or different from each other and are selected from the group consisting of $C_{14}$ to $C_{20}$ alkyl and alkenyl groups, wherein $R_7$ is selected from the group consisting of H, methyl, ethyl and $(C_nH_{2n}O)_xH$ wherein n is 2 or 3 and x is from 1 to about 5 and wherein $X^-$ is selected from halide, ethylsulfate or methylsulfate;

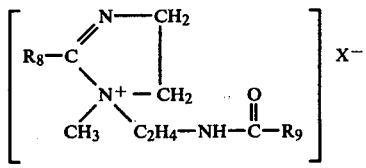

(2)

wherein $R_8$ and $R_9$ are the same or different from each other and are selected from the group consisting of $C_{14}$ to $C_{20}$ alkyl and alkenyl groups, wherein $X^-$ is halide, ethylsulfate or methylsulfate;

(3)

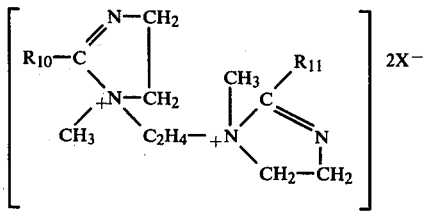

wherein $R_{10}$ and $R_{11}$ can be the same or different from each other and are selected from the group consisting of $C_{14}$ to $C_{20}$ alkyl and alkenyl and $X^-$ is halide, methylsulfate or ethylsulfate;

C. from about 0.05% to 0.6% of an inorganic water-soluble ionizable salt; and

D. water;

wherein the total amount of Components A+B is from about 15% to about 23%, wherein there is unsaturation present on at least one of Components A or B such that the cationic active system has an Iodine Value of at least about 5.7.

2. The composition of claim 1 wherein the Iodine Value is at least about 7.7.

3. The composition of claim 2 wherein Component A is present in the composition at a level of from about 8% to about 10%.

4. The composition of claim 3 wherein $R_1$ and $R_2$ are $C_{14}$ to $C_{20}$ alkyl groups and $R_3$ and $R_4$ are $C_1$ to $C_3$ alkyl groups.

5. The composition of claim 4 wherein Component B is B.(1) and is present in the composition at a level of from about 8% to about 12%, wherein $R_7$ is $-(C_2H_4O)_xH$ and wherein x is from 1 to about 5.

6. The composition of claim 5 wherein the Iodine Value of Components A+B is from about 10.5 to about 34.

7. The composition of claim 6 wherein Component A is dihydrogenatedtallowdimethyl ammonium chloride.

8. The composition of claim 7 wherein Component B is di(2-tallowamidoethyl) ethoxylated methyl ammonium methylsulfate and wherein Component C is calcium chloride.

9. The composition of claim 8 wherein Component A and Component B are each present at a level of about 10%.

10. The composition of claim 4 wherein Component B is B.(2) and is present in the composition at a level of from about 8% to about 12%.

11. The composition of claim 10 wherein the Iodine Value of Components A+B is from about 10.5 to about 34.

12. The composition of claim 11 wherein Component A is dihydrogenatedtallowdimethyl ammonium chloride.

13. The composition of claim 12 wherein Component B is 1-methyl-1-tallowamidoethyl-2-tallowimidazolinium methylsulfate and wherein Component C is calcium chloride.

14. The composition of claim 13 wherein Component A and Component B are each present at a level of about 10%.

* * * * *